United States Patent [19]

Spitzner et al.

[11] Patent Number: 4,518,246

[45] Date of Patent: May 21, 1985

[54] APPARATUS AND METHOD FOR FORMING MULTICOLOR ELECTROPHOTOGRAPHIC IMAGES

[75] Inventors: Jerome G. Spitzner, Byron; Michael D. Stoudt, Webster, both of N.Y.

[73] Assignee: Eastman Kodak Company, Rochester, N.Y.

[21] Appl. No.: 493,867

[22] Filed: May 12, 1983

[51] Int. Cl.[3] ..... G03G 15/01

[52] U.S. Cl. ..... 355/4; 355/14 E; 355/14 TR; 355/77; 430/43; 430/44

[58] Field of Search ..... 355/3 SC, 3 R, 4, 14 R, 355/14 TR, 32, 14 E, 77; 430/43, 44

[56] References Cited

U.S. PATENT DOCUMENTS

| | | | |
|---|---|---|---|
| 3,043,686 | 7/1962 | Bickmore | 96/1 |
| 3,057,720 | 10/1962 | Hayford et al. | 96/1 |
| 3,615,391 | 10/1971 | Honjo et al. | 96/1.2 |
| 3,620,722 | 11/1971 | Hastwell et al. | 96/1.2 |
| 3,799,774 | 11/1972 | Matsumoto | 96/1.2 |
| 3,836,244 | 8/1973 | Lehman | 355/4 |
| 3,844,783 | 10/1974 | Matsumoto et al. | 96/1.2 |
| 3,884,686 | 5/1975 | Bean | 430/43 |
| 3,902,801 | 9/1975 | Lehman | 355/4 |
| 3,910,789 | 10/1975 | Hastwell | 96/1.2 |
| 3,999,988 | 12/1976 | Roetling et al. | 96/1.2 |
| 4,090,876 | 5/1978 | Furuya et al. | 96/1 R |
| 4,168,164 | 9/1979 | Furuya et al. | 355/4 X |
| 4,236,809 | 12/1980 | Kermisch | 355/4 |

FOREIGN PATENT DOCUMENTS 1362528 8/1974 United Kingdom .

*Primary Examiner*—Richard L. Moses
*Attorney, Agent, or Firm*—John D. Husser

[57] ABSTRACT

A plurality of constituent electrostatic color-separation images are produced in sequence for subsequent toner-development and superimposition and at least one developed constituent image is used to color-correct a succeeding constituent image which is not yet developed. Apparatus and method embodiments described herein utilize light which is diffusely-reflected from toner on a developed photoconductor image sector to expose in register, and thus color-correct, an undeveloped electrostatic image on another photoconductor sector. Such auxiliary "scatter-masking" exposures can be predeterminedly or selectively adjusted in tone scale.

50 Claims, 15 Drawing Figures

APPARATUS AND METHOD FOR FORMING MULTICOLOR ELECTROPHOTOGRAPHIC IMAGES

BACKGROUND OF THE INVENTION

1. Field of the Invention

The present invention relates to apparatus and methods for forming multicolor images electrophotographically and more particularly to such apparatus and methods having improved structures and procedures for providing color-corrected reproductions.

2. Description of the Prior Art

Much technical effort has been directed toward developing apparatus and methods for producing high quality color reproductions electrophotographically. One common approach for such effort has been to form constituent color-separation electrostatic images (e.g. by exposing separate photoconductor sectors to a color original respectively through red, green and blue filters), to develop the electrostatic images respectively with different color toner (e.g. cyan, magenta and yellow toner) and then to successively transfer the different toner images in register onto a copy sheet.

One very difficult problem encountered in the above and other electrophotographic color imaging approaches is the correction for unwanted light absorptions of the reproducing system's colorants. For example it is well known that cyan pigments and dyes used in toners often have unwanted green and blue light absorptions (in addition to their desired red light absorption). Similarly, magenta toner often has significant unwanted blue light absorption (in addition to its desired green light absorption). If not corrected for, such unwanted toner absorptions can cause degradation in fidelity of the reproduction's color saturation and hue, as well as a darkening of the copy colors.

A related problem is that of exposure error of the red, green and blue information in the original color document being copied. There are usually side absorptions in the dyes, inks or toners used in the original. When the color-separation filter system is not precisely matched for a particular input colorant set, the amount of cyan, magenta and yellow toner produced in the copy will not be precisely proportional to the amount of cyan, magenta and yellow colorant in the original. For example, the amount of yellow toner produced in the copy will include an amount developed in proportion to the amount of yellow colorant in the original plus amounts developed in proportion to the amounts of cyan and magenta colorant in the original weighted by their respective blue absorptions within the pass-band of the blue color-separation filter which is used. Imperfect matching of the blue filter to the input colorants can cause these amounts of developed toner to differ from the amounts of input colorants in the original, thereby degrading the saturation and hue fidelity of the copy relative to the original.

A variety of solutions have been suggested for "color correcting" for unwanted light absorptions of the output toner colorants. For example U.S. Pat. Nos. 3,615,391; 3,836,244 and 3,844,783 disclose color-correction techniques wherein an element bearing an electrostatic mask pattern is placed into facing relation with a photoconductor sector which bears an electrostatic color-separation image and development occurs with the two electrostatic patterns competing for toner. These techniques involve additional steps (e.g. the formation of the otherwise unutilized mask pattern), are difficult to control accurately and are hard to implement in an automated machine.

Alternatively, an approach similar to graphics arts masking can be used. This involves forming a negative masking toner image and exposing the electrostatic color-separation image to the original through the masking image. Again additional steps are involved and the approach is difficult to implement in an automated machine.

U.S. Pat. No. 4,236,809 suggests performing color correction of a color-separation electrostatic image by selectively discharging it with a scanning laser beam (controlled in accordance with an electrical signal obtained from a previous electro-optic scanning of the original). U.S. Pat. No. 4,090,876 discloses a device using first and second ion modulating screens to form and color correct electrostatic color-separation images. Both of these latter approaches involve complex and expensive equipment additions to the electrophotographic apparatus, with the inevitably coupled problems in maintenance and reliability.

SUMMARY OF THE INVENTION

In view of such difficulties with prior art approaches, a significant purpose of the present invention is to provide, in electrophotographic apparatus and methods, improved structures and techniques for color-correcting images. One important advantage of the present invention is its simplicity, both in function and construction. Another important advantage of the present invention is its effectiveness for producing high quality color correction in highly productive electrophotographic modes and configurations. An additional advantage or the present invention is that it can be utilized to correct for exposure errors caused by an imperfect match of color-separation filters with the colorants of input originals, as well as to color correct for unwanted color absorptions of the toner(s) used in forming electrophotographic reproductions.

In one aspect the present invention provides in an electrophotographic imaging method of the type wherein a plurality of photoconductor image sectors are respectively processed to form different electrostatic color-separation images of a predetermined color original, and developed with different color toner, the improved color-correcting procedure of reflecting light from the toner on a developed one of the photoconductor sectors to discharge, in register, the electrostatic color-separation image on another, undeveloped one of the photoconductor sectors.

In another aspect the present invention provides, in color electrophotographic apparatus, color-correcting structures for reflecting light from the toner image on one developed photoconductor image sector, in register, to the electrostatic color-separation image on another photoconductor image sector.

The present invention also provides highly useful procedures and structure whereby the light-reflection exposure of the electrostatic color-separation image from the toner image, is adjustable, e.g. in tone scale, to more accurately correct for unwanted light absorption characteristic of output toner(s), exposure errors regarding input colorants and/or some other color imbalances perceived in the original or its reproduction.

BRIEF DESCRIPTION OF THE DRAWINGS

The subsequent description of preferred embodiments of the invention refers to the attached drawings wherein.

DETAILED DESCRIPTION OF THE PREFERRED EMBODIMENTS

Figure 1A:
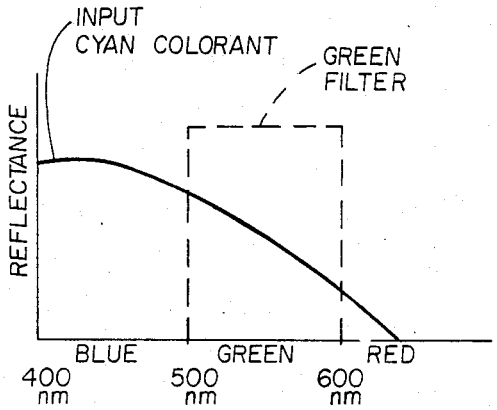
FIGS. 1A to 1D are graphs useful in explaining general theoretical aspects, principles and guidelines of the present invention.

Before proceeding to a detailed description of exemplary preferred procedures and embodiments of the present invention, a general description of its approach and physical mechanisms will be helpful, both for understanding such detailed embodiments and for providing general guidelines for effecting other embodiments. This general description also will be helpful toward use of the invention with many different toner and input original colorant sets.

Certain general masking principles used in the present invention are similar in some respects to approaches used in graphic arts photography, where photographic reproductions are improved by means of auxiliary masking exposures. Photographic masking usually involves the preparation of auxiliary mask images with a linear, long-scale negative film whose gamma (ratio of output contrast to input contrast) can be adjusted and controlled by the photographic process. Exposure of the photographic print is carried out with such predeterminedly prepared, auxiliary mask(s) registered to the principal image. The auxiliary masks may be monochromatic, colored, sharp, unsharp, separate or combined. The gammas of the photographic masks are based upon the light absorption characteristics of the principal colorants, which are known for many original and reproductive medium (e.g. commercial negative films and print papers) or are measurable by known techniques. In determining the types and magnitudes of correction for particular colorants, one skilled in the art will find it helpful to consider such background information from photographic masking technology in conjunction with the teachings of the present invention.

In accord with the present invention, a masking light image for an electrophotographic latent image is generated optically, directly from a previously developed toner image, by means of light scatter-reflected from the toned image. The scatter-reflection-masking technique of the present invention is particularly advantageous in color electrophotographic processes where different constituent toner images (e.g. cyan, magenta and yellow toner images) are produced sequentially for subsequent superimposition. That is, when the constituent color images and their complementary latent electrostatic images (e.g. red, green and blue color-separation electrostatic images) are produced sequentially, a first developed image can itself be used to generate a scatter-reflection-masking light image for another, undeveloped electrostatic latent image.

For example, the formation of constituent electrostatic color-separation images in the order red-green-blue permits scatter-masking correction of the unwanted green and blue light absorptions of the red-light record (i.e. its cyan toner) and the unwanted blue absorption of the green-light record (i.e. its magenta toner). Often other unwanted toner absorptions are small enough to be ignored. Thus the technique of scatter-masking, applied in electrophotographic systems, offers advantage over conventional color masking techniques by its freedom from the auxiliary preparation of mask images. Since the mask images of the present invention can be optically derived from the same toned frames that will be assembled to form the final print image, and applied in-line, the scatter-mask system provides flexible, highly productive color correction.

Consider now some general physical mechanisms of the scatter-reflection masking approach of the present invention. When the toner particles are deposited on the surface of a photoconductor image sector, they present a rough, light-scattering surface. Preferred photoconductor surfaces for practice of the present invention exhibit minimum diffuse reflectivity. The preferred masking illumination for practice of the present invention includes significant spectral content to which a photoconductor sector that is to be color-corrected is photosensitive and to which the unfused toner particles are efficiently scattering (e.g. not completely absorbing).

Given the above characteristics, when masking illumination is directed onto a developed photoconductor image sector, the amount of light scattered from a toner image portion thereof is generally proportional to the amount of toner which constitutes that image portion. In accord with the present invention, the masking light image, formed by light scatter-reflected from the various toner image portions on the developed photoconductor sector, is directed, in imagewise register, to modulate and color-correct an undeveloped electrostatic image. The different intra-image intensity levels or "tone scale" of such masking light image can be adjusted, e.g. by varying the incident angle at which masking illumination is directed onto the developed image sector, the geometry of the optical system, the level of masking illumination, the spectral quality of the masking illumination or the time of masking exposure. Preferred scatter-masking correction parameters (e.g. tone scale adjustments) can be readily determined by one skilled in the art for colorants sets having known absorption parameters, e.g. with reference to well-known photographic masking equations.

The approaches for scatter-mask color-correction in accord with the present invention can be further understood by considering the following simplified example. Suppose the cyan colorant of an input original colorant set has the light reflectance characteristics shown in FIG. 1A. (Note particularly the dip in green light reflectance due to sideband, green light absorbance of the cyan colorant.) This side-band green absorbance of cyan colorant may be well accommodated by the overall balance of the original's colorant set; however, exposures through color filters can disrupt this original balance and give rise to exposure errors, Thus, if the filter used to make a green color-separation exposure of the input original is represented by the dotted line in FIG. 1A, the green light absorption of the cyan colorant in the input original (i.e. its lowered green-light reflectance or transmission) will cause a certain reduction in the electrostatic discharge of the green electrostatic color-separation image frame (and a resulting increase of magenta toner deposition on that frame), where cyan colorant was present in the original. If the cyan reflectance curve were different or if the filter pass-band were different, the cyan-related, reduction in magenta image charge would differ. This gives rise to exposure variations or errors based upon the different match of filters to differing input colorants. Since the scatter-masking system described above can selectively reduce the voltage of the green electrostatic color-separation image frame where cyan colorant is present in the original, it is highly useful to selectively reduce the amount of magenta toner from that normally deposited in areas corresponding to cyan colorant in the original and thus correct for such exposure errors.

Figure 1D:
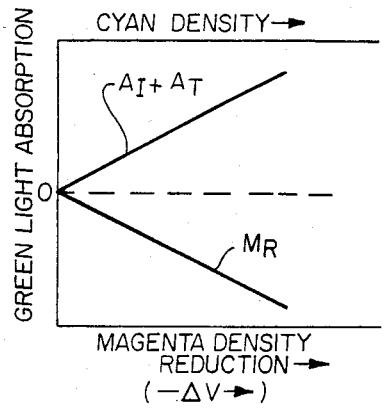
Figure 1B:
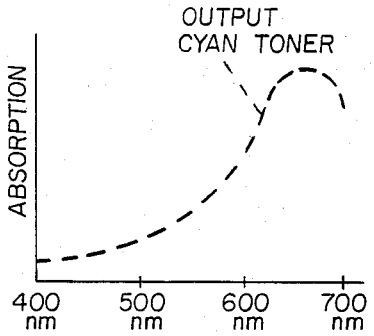

Further, suppose the cyan toner particles (of the output colorant set) for development of a red-color-separation image have the light absorption characteristic indicated in FIG. 1B. The toner exhibits a substantial unwanted green light absorption. The unwanted green light absorption of individual pixel portions of a photoconductor image sector developed with the FIG. 1B cyan toner, will increase proportionally with their increased cyan toner density as indicated by curve $A_T$ in FIG. 1C. Without correction this unwanted green absorption of cyan toner causes a significant decrease in fidelity of the final copy output. Scatter-masking exposure of the electrostatic green color-separation image to the developed cyan toner image decreases the deposition of magenta toner selectively, i.e. where cyan toner exists.

Figure 1C:
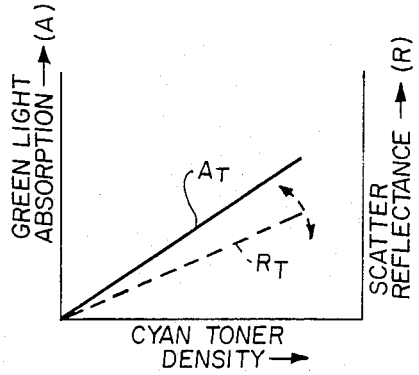

Moreover, we have found that the scatter-reflectance of the cyan toner image portions increases in a generally direct proportion with increased cyan toner density of those portions (see the exemplary dotted line curve $R_T$ in FIG. 1C). The light image which is scatter-reflected from the cyan toner image thus comprises a plurality of different intra-image intensity levels, or a tone scale. Further we have found that the general position, e.g. slope, of the curve $R_T$ can be adjusted. Therefore, by adjusting the curve $R_T$(e.g. by changing the magnitude, duration, spectral content or incidence angle of the source illumination or by varying the light path to the corrected image sector), the tone scale of the masking exposure can be adjusted.

As shown in FIG. 1D, one objective for such tone scale adjustment (of curve $R_T$) might be to cause the magenta density reduction curve $M_R$, which it controls, to more precisely compensate for (e.g. be a mirror image to) cumulative green light absorption inaccuracies of the cyan toner image. That is, the input colorant-/filter mismatch exposure errors explained above have a green light absorption to cyan toner density characteristic ($A_I$) as does the intrinsic unwanted green light absorption of the cyan toner itself (characteristic $A_T$). The combined effect of these inaccuracies in green light absorption by cyan toner are indicated by curve $A_I+A_T$. Of course either an $A_I$ curve or an $A_T$ curve can be compensated for singly.

More specifically, as indicated in FIG. 1D, the magenta density reduction ($M_R$) is implemented by electrostatic charge reductions ($-\Delta V$) in the latent electrostatic magenta color separation image. This results from scatter light reflectance from the developed cyan toner image frame to the magenta electrostatic image frame. The increased "reduction" in electrostatic charge (increased $-\Delta V$) will subsequently manifest itself in reduced magenta toner density, i.e. after development of the magenta frame. Thus adjustment of the curve $R_T$ (FIG. 1C) ultimately controls the position of magenta density reduction curve $M_R$ (FIG. 1D) so that the curve $M_R$ can be adjusted to color-correct for green absorption inaccuracies of the developed cyan toner image such as curve $A_I+A_T$(which can be calculated or measured).

The above analysis holds for other light absorption inaccuracies (e.g. the unwanted blue light absorptions of cyan and magenta toners or the exposure errors due to filter mismatch with input colorants during blue record exposure). With knowledge of the pass-bands of the color-separation filters to be used, one skilled in the art therefore can (1) measure (or find from published reference data) the absorptions of the input colorant and/or output toners, (2) plot absorption curves (such as $A_T$ in FIG. 1C or $A_I+A_T$ in FIG. 1D) and (3) adjust the tone scale of the scatter-reflectance light image (curve $R_T$, FIG. 1C), in accord with the various modes of the present invention discussed below, to obtain the desired density reduction curve(s) such as curve $M_R$ shown in FIG. 1D. Often color corrections will be performed solely with respect to the unwanted absorptions of the outut toner sets; however the preceding discussion explains how even more sophisticated color correction (including compensations for input colorant-/filter mismatch) can be effected.

Figure 2A:
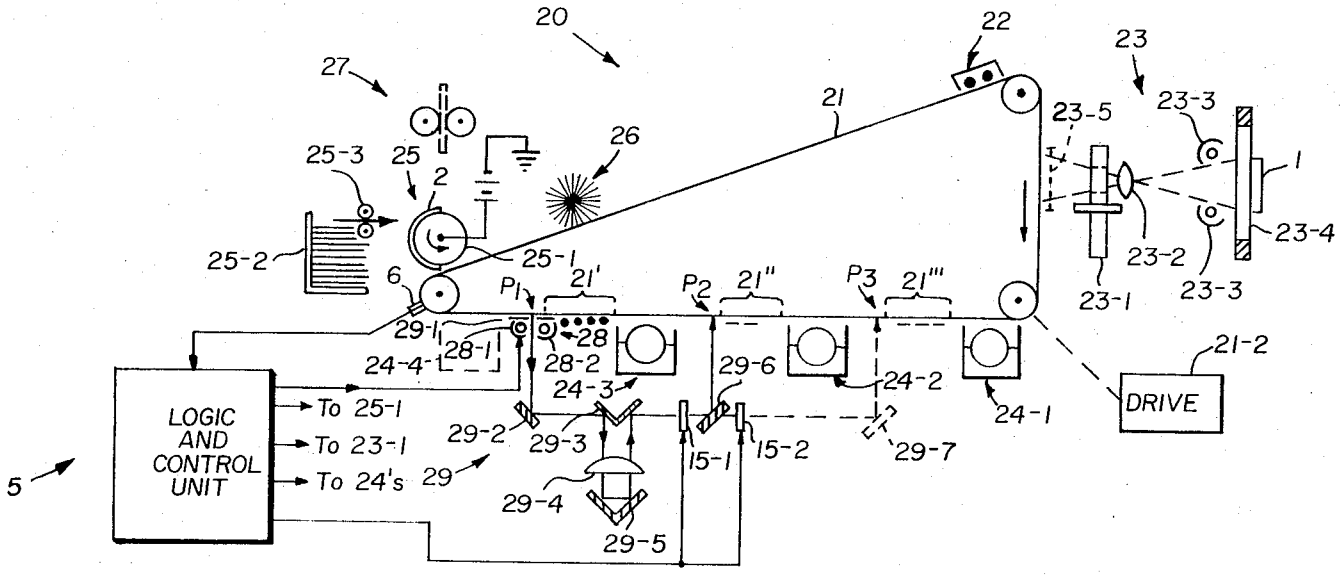
FIG. 2A is a schematic side view of one apparatus useful in accord with the present invention.

FIG. 2A illustrates a schematic side view of one embodiment of electrophotographic apparatus 20 for producing multicolor copies of a multicolor original in accord with the present invention. Useful photoconductors in accord with the present invention include the kinds which can be charged and exposed to form a latent electrostatic image. In embodiments where a multicolor original is exposed successively through red, green and blue filters onto successive photoconductor sectors of the same construction, it is desirable that the photoconductor sectors have good panchromatic sensitivity. Additionally, in accord with the present invention, it is important that the photoconductor be selected to cooperate with the particular embodiment of scatter-masking system that is employed and vice versa. Thus it is desirable that the photoconductor sectors and masking illumination source be selected so that the color-corrected photoconductor sector will receive scatter-reflected light to which it is photosensitive.

Additionally the photoconductor sectors, toner and masking illumination source are desirably selected so that substantially only that light which is scatter-reflected from toner, passes to the color-corrector sector. For this purpose the photoconductor can be specularly reflective to masking illumination, with the masking illumination directed obliquely at the toner-bearing sector and the transmission optics constructed to transmit diffuse but not specular reflection. Alternatively the photoconductor can be highly transmissive or highly absorptive to the masking illumination, or can be transmissive or absorptive, in addition to being specularly reflective to such illuminating radiation. Of course, it is desirable to select the spectral content of the masking illumination with respect to the illuminated toner image so that a significant amount of light is scatter-reflected (e.g. not absorbed) by the toner.

The photoconductor 21 of apparatus 20 is in the form of an endless belt having a plurality of spaced photoconductor image sectors, or frames, which are moved around an operative path by drive means 21-2; however, the photoconductor can take various other forms known in the art, e.g., separate sheets or a cylinder(s) as described in more detail subsequently. Around the operative path of travel of photoconductor 21 are a primary charging device 22; a main-exposing device 23 for exposing the primary-charged photoconductor to successive color-separation light images of the multicolor original 1; development devices 24-1, 24 TM 2 and 24-3, respectively for applying different toners to different color-separation electrostatic images formed on the photoconductor; a transfer device 25 and a cleaning device 26. A fusing device 27 is located to receive and fix copy sheets 2 after completion of transfer of the toner images.

The charging device 22 of the FIG. 2A embodiment is a corona discharge electrode, e.g., D.C., D.C. biased A.C. or grid controlled D.C.; however, any other structures suitable for providing a uniform electrostatic charge on the photoconductor can be used.

The main-exposing device 23 of the FIG. 2A embodiment includes an array 23-1 of color filter elements, a lens 23-2, light sources 23-3 for flash exposing the original 1 on exposure platen 23-4, through half-tone screen 23-5, onto the photoconductor 21. However, many other exposure devices are useful in the present invention. For example any one of the various devices for optically strip scanning a moving or stationary original onto a photoconductor image member are useful. Also, electronic imaging devices such as a modulatde laser, a light valve array or a light emitting diode array can be utilized. Thus the multicolor original can be an electronic signal record of a multicolor image to be reproduced. As used herein with respect to its application to photoconductor members the term "light" is intended to include non-visible electromagnetic radiation, e.g. such as I.R. and U.V., which is useful in imagewise activating the photoconductor members. In certain embodiments of the invention imaging systems comprising an array of stylus discharge devices or ion stream modulators can be used instead of primary-charging and main-exposing devices 22 and 23.

The devices 24-1, 24-2 and 24-3 of the FIG. 1 embodiment are magnetic brush applicators, respectively for applying cyan, yellow and magenta toner. Such magnetic brushes can be of the kind using single or dual component developers e.g. including insulative, conductive or magnetic toners. However, other toner applicators such as, e.g., cascade, liquid or fur brush are useful in accord with the present invention. The development devices 24-1, 24-2 and 24-3 are operable selectively on particular photoconductor sectors under the control of logic and control unit 5, e.g., by movement up and down, by skive control or by other such techniques. If desired a black toner development device 24-4 (dotted lines in FIG. 2A) can also be provided.

The transfer station 25 of the FIG. 2A embodiment comprises a transfer device including an electrically biased transfer roller 25-1, a supply 25-2 of copy sheets and feed rollers 25-3. Various other transfer devices such as corona devices and adhesive transfer systems can be used. A suitable detack structure (not shown) is provided to direct a copy sheet from station 25 to fusing device 27 after transfer is complete. The cleaning device 26 can be a fur brush, a vacuum source, a fibrous belt or other such devices to remove toner that is not transferred to the copy sheet 2 at station 25. In some embodiments a cleaning device may not be needed.

In the FIG. 2A embodiment, the devices 28 and 29 provide means for scatter-reflecting light from the toner image on one developed image sector of photoconductor 21, in register, to the electrostatic color-separation image on another image sector of photoconductor 21. The device designated generally 28 is for scatter-reflecting light from a developed color-separation toner image and in this embodiment comprises a plurality of light sources 28-1, 28-2 directed to illuminate strip portions of the photoconductor 21 and developed toner images that move therepast. The.sources 28-1 and 28-2 are positioned to direct light at a non-normal angle to the surface of the photoconductor 21 so that: (1) light from the sources that is scatter-reflected from (or diffused by) the toner passes through scan slit 29-1 and (2) light which is specularly reflected from non-toned areas of the photoconductor does not pass through scan slit 29-1. As pointed out in the preliminary general discussion, the light from the masking illumination sources includes a spectral content which will be efficiently scattered by the toner and to which the photoconductor is photosensitive. The magnitude of scattered light from the various portions of the developed image sector is proportional to the magnitude of toner (toner density) on those portions.

In the FIG. 2A embodiment, the device designated generally 29 is for guiding light that is scatter-reflected from the toner, in register, to an electrostatic color-separation image on another photoconductor image sector. The device 29 comprises mirrors 29-2 and 29-3 half lens 29-4 and mirrors 29-5 and 29-6 and directs the scatter-reflected light in an imagewise pattern to the electrostatic image bearing sector which is to be correction-modulated. If desired mirror 29-6 can be a half-mirror and light directed by the light guiding system can also pass the correcting light pattern (dotted lines) to an additional electrostatic color-separation image on another image sector of the photoconductor 21, e.g. via a mirror 29-7. 1

The color electrophotographic imaging apparatus 20 shown in FIG. 2A operates under the control of logic and control unit 5, (e.g. a microprocessor) which receives signals from detector 6 as to the precise position of the photoconductor 21 and provides actuation and other control signals to the devices at various stations (e.g. charge, expose, development, transfer, etc) described above. In one exemplary imaging sequence a color original 1 is placed on exposure platen 23-4 and a start signal is actuated by the operator. A first sector of the photoconductor 21 is moved past primary charging device 22 and into the exposure plane of lens 23-2. Filter array 23-1 is actuated to align a red filter in the optical path and exposing flash lamps 23-3 are energized to expose the primary-charged photoconductor sector to the original to form an electrostatic red color-separation image on that first photoconductor image sector. The first sector advances to development devices 24 and magnetic brush 24-1 is selectively activated to apply cyan toner to develop the electrostatic red color-separation image. Meanwhile a second photoconductor sector advances past charging device 22 and is exposed through a green filter of the array 23-1, which has been re-indexed by control unit 5, to form an electrostatic green color-separation image. Likewise a subsequent third photoconductor sector is primary charged and exposed to the original through a blue filter of array 23-1 to form an electrostatic blue color-separation image.

At the stage of the color reproduction operation shown in FIG. 2A, the first, second and third photoconductor image sectors 21', 21'', and 21''' are approaching the illustrated positions $P_1$, $P_2$ and $P_3$. It will be noted that the relative locations on belt 21 of those sectors are such that the leading edge of the sector bearing the developed red color-separation image will pass scan slit 29-1 as the leading edge of the sector bearing the undeveloped electrostatic green color-separation image passes the position along the photoconductor belt path where scatter-reflected light passing the scan slit is directed by mirror 29-6. Also note that the relative position of the third sector is such that the leading edge of the blue color-separation image will pass the path of scatter-reflected light guided to the photoconductor path by mirror 29-7 in synchronization with the leading edge of the first sector passing scan slit 29-1.

As the leading edges of the sectors 21', 21'' and 21''' pass respectively to postions $P_1$, $P_2$ and $P_3$, sources 28-1 and 28-2 are energized to scatter-reflect light from the cyan toner image on sector 21' whence optical structure 29 guides the reflected light "in register" onto the undeveloped electrostatic green color-separation image on sector 21'' (and, if desired, onto the undeveloped electrostatic blue color-separation image on sector 21''').

Figure 2B:
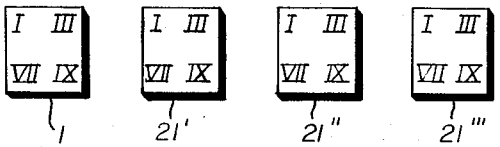
FIG. 2B is a diagram indicating the relative orientation of registered images.

FIG. 2B illustrates the meaning of the term of "in register." Thus the portions I, III, VII and IX on diagram 1 indicate particular portions of the multicolor original 1 to be reproduced and numerals I, III, VII and IX on the other diagrams in FIG. 2 indicate portions of the first, second and third photoconductor sectors 21', 21'' and 21''' that correspond to the similarly numbered original portions. Light directed "in register" from toner on one photoconductor sector to an electrostatic image on another sector, e.g., from 21' to 21'' is directed so that toner reflected light from portion I of sector 21' passes to portion I of sector 21'' etc. The term "in register" thus includes light which is optically imaged (in sharp or unsharp focus) between photoconductor sectors as well as light which is otherwise directed in a patternwise fashion as indicated by FIG. 2B.

Thus by the above-described procedure light is scatter-reflected and guided to discharge portions of the electrostatic green color-separation image in proportion to the amount of cyan toner on the respectively corresponding portions of the developed red color-separation image. As explained in more detail previously with respect to FIGS. 1A to 1D, such imagewise discharge can be used to correct or adjust for the undesired green light absorption of the cyan toner (and/or for exposure error due to an imperfect match of the green filter exposure vis-a-vis the cyan colorant in the original). In a similar manner light scatter-reflected and guided from the developed cyan toner image to the electrostatic blue color-separation image can be used to correct or adjust for unwanted blue light absorption of the cyan toner (and/or for exposure error due to an imperfect match of the blue filter exposure vis-a-vis the cyan colorant in the original).

The optimum intra-image intensity levels, or tone scale, for the scatter-masking exposures such as described above can be predetermined, e.g. based on the known characteristics of the output toners, the colorants of the input original and the transmission characteristics of the color separation filters as discussed with respect to FIGS. 1A to 1D. Alternatively, scatter-masking exposure levels can be determined empirically, or even subjectively. For a given color set of output toners, it is often preferable that there be a predetermined tone scale value assigned to the different color-correcting exposures (e.g. a certain value for the cyan toner image to green color-separation electrostatic image exposure, another one for the cyan toner to blue color-separation electrostatic image exposure and another one for the magenta toner image to blue color-separation electrostatic image exposure). For this purpose, logic and control unit 5 can include control means for synchronizing a plurality of different predetermined tone scale adjustments of the scatter-masking means in time relation with the movement of the photoconductor. Similarly, for known color-separation filter transmissions and known input originals (e.g. particular types of color photographic print papers) which have known colorant sets, tone scale adjustment values for filter mismatch exposure errors can be selectively programmed into logic unit 5 (in combination with or separately from output toner correction values) to further adjust the scatter-reflection exposure.

Figure 3:
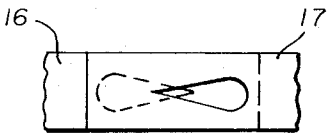
FIG. 3 is an enlarged plan view of one embodiment of the exposure control device shown in FIG. 1.

As noted above, various tone scale adjustment means can be utilized for varying the scatter-reflection discharge of latent electrostatic images (e.g. shifting the position of curve R in FIG. 1C). For example, the illumination intensity level of lamps 28-1, 28-2 can be varied or the aperture of the exposure can be varied with a diaphragm. Devices 15-1, 15-2 of FIG. 2A have apertured blades 16 and 17 (see FIG. 3) that are movable under the control of unit 5 to vary the intensity of exposures along their light paths. In one preferred mode, devices 15-1 and 15-2 can have different aperture settings to provide a different tone scale for: (1) the cyan toner/green electrostatic image and (2) the cyan toner/blue electrostatic image. In embodiments where scatter-reflection is effected with a flash exposure (rather than a scanning exposure) illumination control can be effected by using blades 16, 17 as a shutter which closes after a predetermined interval or by quenching the flash source. Illumination control can be effected also by varying the illumination geometry of the illumination system, e.g. changing the angle of light direction to the toner image. Also, the spectral content of the scatter-reflection source can be varied, thereby causing it to be more or less absorbed by the toner and thus less or more scatter-reflected. Other structures and modes for adjusting tone scale of the scatter-masking image will occur to those skilled in the art.

Another highly useful feature of the present invention is that it can also be used to adjust or correct certain characteristics which the operator perceives in the original itself or in a "trial" reproduction. For this purpose a level of scatter-masking exposure can also be selectively adjustable.

After its masking exposure with scatter-reflected light from the developed cyan toner image, the electrostatic green color-separatiqn image is developed with magenta toner by magnetic brush 24-3 (activated by unit 5). Similarly, the electrostatic blue color-separation image is developed with yellow toner by selectively activated magnetic brush 24-2. During this period the cyan toner image on the first photoconductor sector 21' is moved to transfer station 25 and transferred to a copy sheet on roller 25-1. Successively thereafter the magenta any yellow toner images on the second and third photoconductor sectors 21'' and 21''' are moved to station 25 and transferred onto the copy sheet in register. The copy sheet is then detached from roller 25-1 and fed to and fixed by fusing device 27 by conventional structure (not shown).

Figure 5:
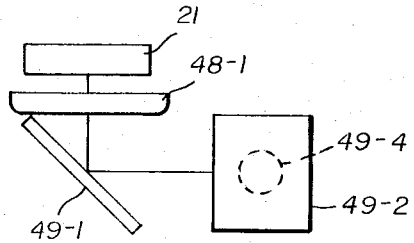
FIGS. 4 and 5 are plan and side views of another embodiment for light reflecting and guiding in accord with the present invention.
Figure 4:
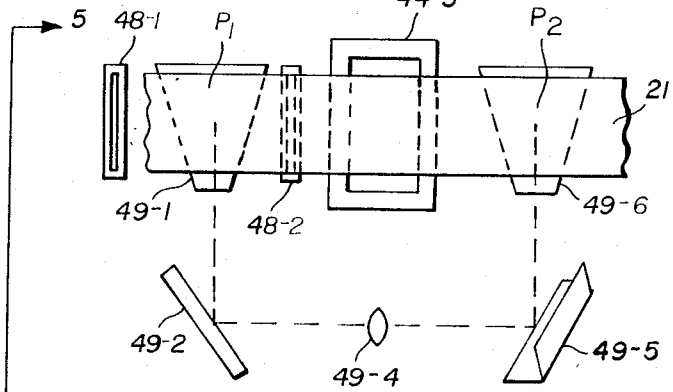

FIGS. 4 and 5 are top and end views illustrating an alternative embodiment for guiding light, reflected from a toner image on a developed photoconductor sector, to an electrostatic image on another photoconductor sector. In this embodiment sources 48-1 and 48-2 are flash lamps and planar mirrors 49-1 and 49-2, lens 49-4, roof mirror 49-5 and planar mirror 49-6 guide the light reflected from the developed photoconductor sector at $P_1$, around development device 44-3, to the undeveloped, electrostatic image bearing sector at $P_2$. The flash lamps are triggered by apparatus logic and control when the image sectors are centered with respect to the light guiding optical structure.

Figure 6:
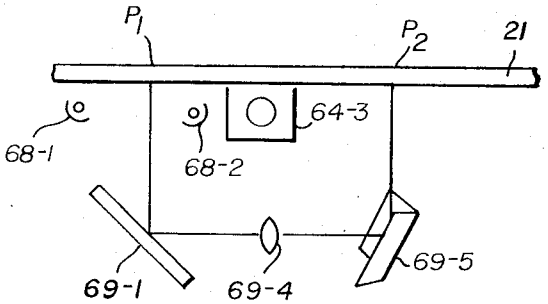
FIG. 6 is a side view of one alternative structural embodiment for light reflecting and guiding in accord with the present invention.

Another configuration for light reflecting and guiding structure in accord with the invention is shown in the side view of FIG. 6. Here sources 68-1 and 68-2 are fluorescent lamps and lens 69-4, in cooperation with planar mirror 69-1 and roof mirror 69-5, scans portions of reflected light from the toner image passing $P_1$, beneath development device 64-3, to corresponding in-register portions of an electrostatic image passing position $P_2$.

Figure 7:
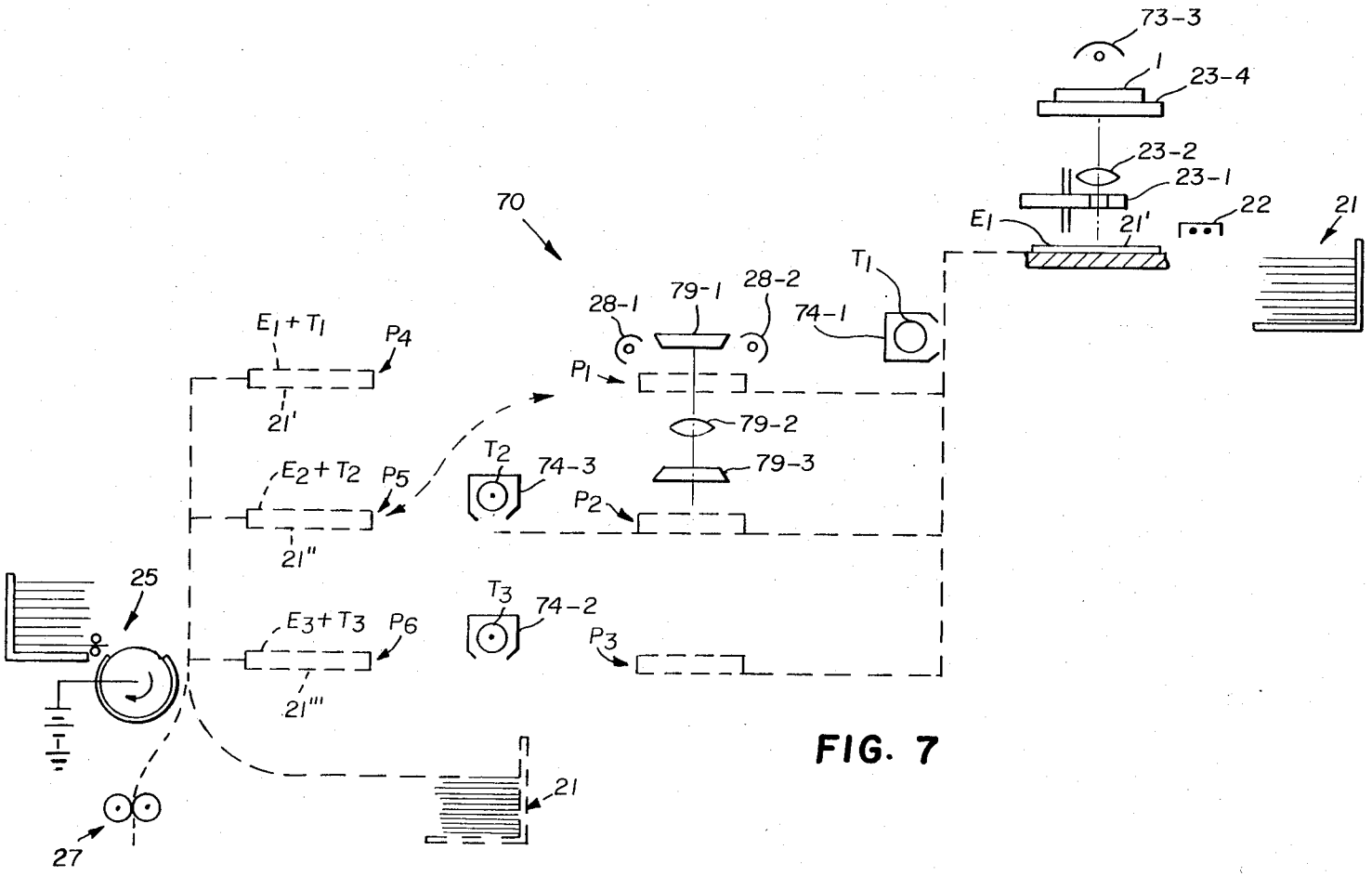
FIG. 7 is a schematic side view of another embodiment of the present invention.

FIG. 7 is a schematic side view of another embodiment of electrophotographic apparatus 70 that employs the present invention to produce multicolor copies of a multicolor original. Apparatus 70 is adapted for use with a color transparency original 1 and the photoconductor sectors, designated generally 21, are sheets that are transported along different operative paths within the apparatus. The main-exposing station provides transmission illumination by exposing source 73-3 but is otherwise similar to that described with respect to FIG. 1, as are charger 22, developing devices 74-1, 74-2, 74-3, transfer device 25 and fusing device 27. In operation, a first photoconductor sheet 21' is uniformly charged, imagewise exposed through a color filter of array 23-1 (to form a first electrostatic color-separation image $E_1$) and then developed with a first toner color $T_1$ by device 74-1 (to form a developed image $E_1+T_1$). The sheet 21' is then fed to position $P_1$. Next a second photoconductor sheet 21'' is uniformly charged, imagewise exposed through a different color filter (to form a second electrostatic image $E_2$) and fed to position $P_2$. At this stage, light sources 28-1 and 28-2 are activated to scatter-reflect light from the toner image on sector 21' to optical structure (designated schematically in part by mirrors 79-1 and 79-3 and lens 79-2), which guide scatter-reflected light, in register, to the electrostatic image $E_2$ on sector 21''. This procedure can be used, for example, to correct the green color separation electrostatic image for unwanted green light absorption of cyan toner, or to provide other color-corrections discussed previously.

Sector 21'' is then fed to position $P_5$ along a path past development device 74-3 so as to receive toner $T_2$ in accordance with its adjusted electrostatic image. Next a third photoconductor sector 21''' is uniformly charged, imagewise exposed through a third color filter and moved to position $P_2$ Again light sources 28-1 and 28-2 are activated to scatter-reflect light from the toner on sector 21' (at position $P_1$) and the scatter-reflected light is guided in register to correct electrostatic color-separation image $E_3$ on sector 21''' (at position $P_2$). This procedure can be used, for example, to correct the blue color separation electrostatic image for unwanted blue light absorption of cyan toner. Next sector 21' is moved to position $P_4$ and sector 21'' is moved from position $P_5$ to position $P_1$ Again light sources 28-1 and 28-2 are actuated to scatter-reflect light from toner on sector 21'' (at position $P_1$) to optical structure 79-1, 79-2, 79-3 which guides it in register to discharge electrostatic color-separation image on sector 21''' (at position $P_2$) a second time. This procedure can be used, e.g., to correct the image $E_3$ for the unwanted light absorption (with respect to the light color which originally exposed image $E_3$ e.g. blue) of toner $T_2$ (e.g. magenta).

Next sector 21'' is fed back to position $P_5$ and sector 21''' is fed to positi $P_6$ via position $P_3$ so as to pass development device 74-2 which applies toner $T_3$ in accord with the modulated electrostatic image $E_3$ on sector 21'''.

Finally sectors 21', 21'' and 21''' can be fed into transfer device 25 sequentially, in any desired order, so as to form toner image $T_1+T_2+T_3$ on the copy sheet in a layer order, which need not correspond to the sequence of toner image formation. This is an advantageous capability because the optically preferred layering sequence of toner colors on the copy sheet is not always the same sequence as that which facilitates best scatter-masking color correction. After transfer of the toner images, in register, the copy sheet is detached and fed to fusing device 27 and the photoconductor sectors are fed back to supply 21. Although not shown in the schematic illustration, it will be appreciated that a logic and control unit such as shown in FIG. 2A will be incorporated in apparatus 70 to effect synchronized operation of the various apparatus devices and accomplish the functional operation just described.

Figure 8:
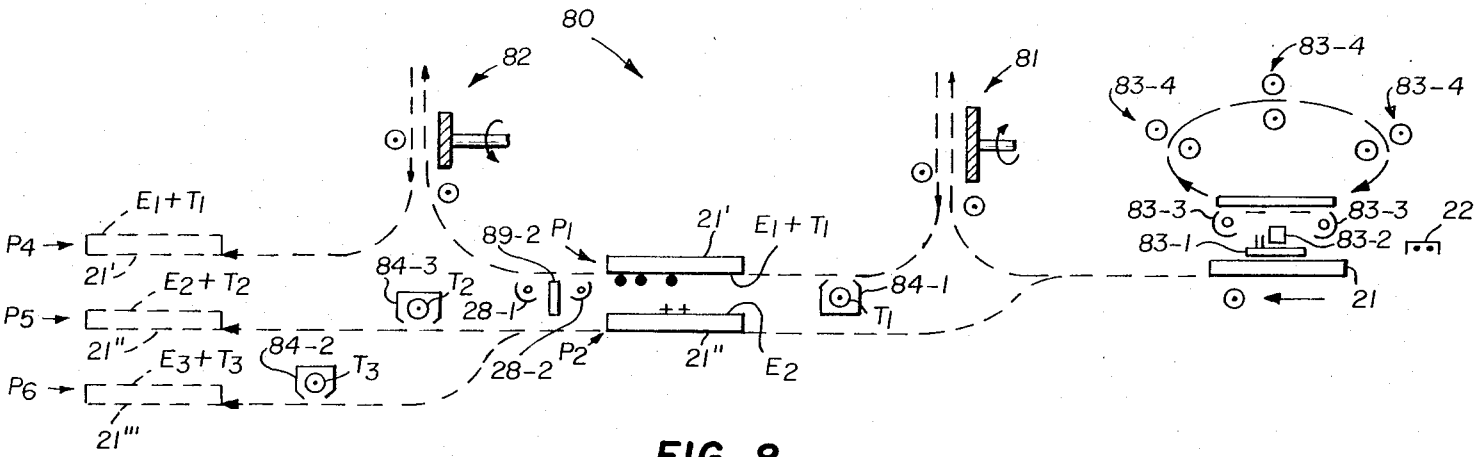
FIG. 8 is a schematic side view of another embodiment of the present invention.

Another example of the present invention is shown in FIG. 8. The photoconductor 21 of apparatus 80 is in discrete sheet format as described with respect to FIG. 7. However, in apparatus 80 the reflection original 1 is recirculated by feeder 83-4 to make sequential passes across light sources 83-3. Filter array 83-1 is indexed to place a different color filter in the scan path for each successive scan pass of the original. Lens 83-2 images successive, different color filter exposures of the original on successive charged photoconductor sectors 21', 21'' and 21''' as described before.

In operation of apparatus 80, the first sector 21' is uniformly charged and imagewise exposed to form image $E_1$. Sector 21' is then transported to a turn-over and 180°-invert device 81 which reorients sector 21' and feeds it toward position $P_1$ with the image side facing downward and rotated 180° from its original position. On route to position $P_1$, the sector 21' is fed past development device 84-1, which applies toner to form developed image $E_1+T_1$ on the image side. A second film sector 21'' is next uniformly charged and imagewise exposed to form a different electrostatic color-separation image $E_2$. Sector 21'' is then fed to position $P_2$ in its original orientation, which is the stage of operation pictured in FIG. 8. Sectors 21' and 21'' are then fed synchronously in facing relation past light reflecting sources 28-1 and 28-2. A fiber optic array, or a gradient index fiber optic lens array, 89-2 guides light that is scatter-reflected from successive portions of toner image $E_1+T_1$ in register onto electrostatic image $E_2$. Sector 21'' is then fed past development device 84-3 to position $P_5$.

Next, sector 21' is returned to position $P_1$ and sector 21''' is uniformly charged and imagewise exposed to form another electrostatic color-separation image $E_3$. Sector 21''' is then moved to position $P_2$. Now sectors 21' and 21''' are fed past sources 28-1 and 28-2 and lens 89-2 guides scatter-reflected light to modulate electrostatic image $E_3$ according to toner image $E_1+T_1$. Color-corrected electrostatic image $E_3$ is then fed past development device 84-2 to position $P_6$. Sector 21' is fed into device 82 to return it to its original orientation and moved to position $P_4$. Sequential transfer of images $T_1$, $T_2$ and $T_3$ can then be effected as previously described with respect to FIG. 7.

Figure 9:
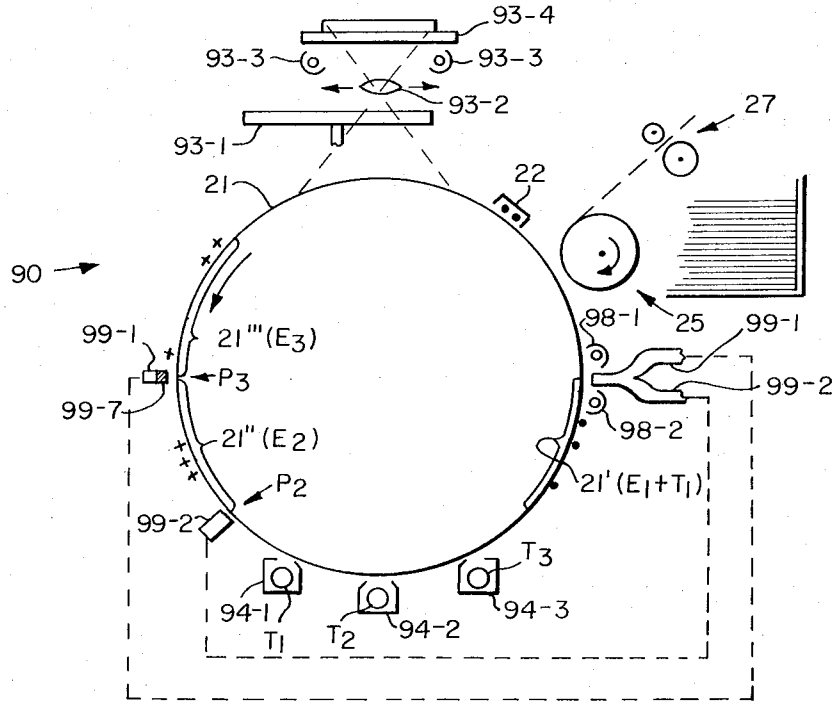
FIG. 9 is a schematic side view of another embodiment of the present invention.

A further example of the present invention is shown in FIG. 9, which is a schematic side view of another electrophotographic apparatus 90 for forming multicolor copies of a multicolor original. In this embodiment the photoconductor 21 comprises a plurality of sectors on the periphery of a rotatable drum. The exposure station is similar to those previously described; however, lens 93-2 moves in synchronism with the drum to successively scan different color-separation exposures to sectors 21', 21'', and 21''' . Filter array 93-1 is indexed between the different sector exposures. Also primary charger device 22, transfer device 25, fusing device 27 and development devices 94-1, 94-2 and 94-3 are similar to those previously described. In this embodiment light from sources 98-1 and 98-2 is scatter-reflected from the developed color-separation image $E_1+T_1$ on sector 21' when it reaches position $P_1$. The scatter-reflected light from toner image $E_1+T_1$ is guided in register to positions $P_2$ and $P_3$ by fiber optic bundles 99-1 and 99-2 to discharge the electrostatic color-separation images $E_2$ and $E_3$ respectively on sectors 21'' and 21'''. After images $E_2$ and $E_3$ have been so discharged (e.g. to compensate for unwanted absorptions to their respective main-exposing light colors of toner $T_1$), they are developed respectively by devices 94-2 and 94-3. The toner images $T_1$, $T_2$ and $T_3$ are thereafter transferred to a copy sheet and fixed as described previously. In this embodiment a neutral density filter 99-7 is disposed in the light path of fiber optic bundle 99-1 to provide for a difference in magnitude of color-correction exposure between $E_2$ and $E_3$.

Figure 10:
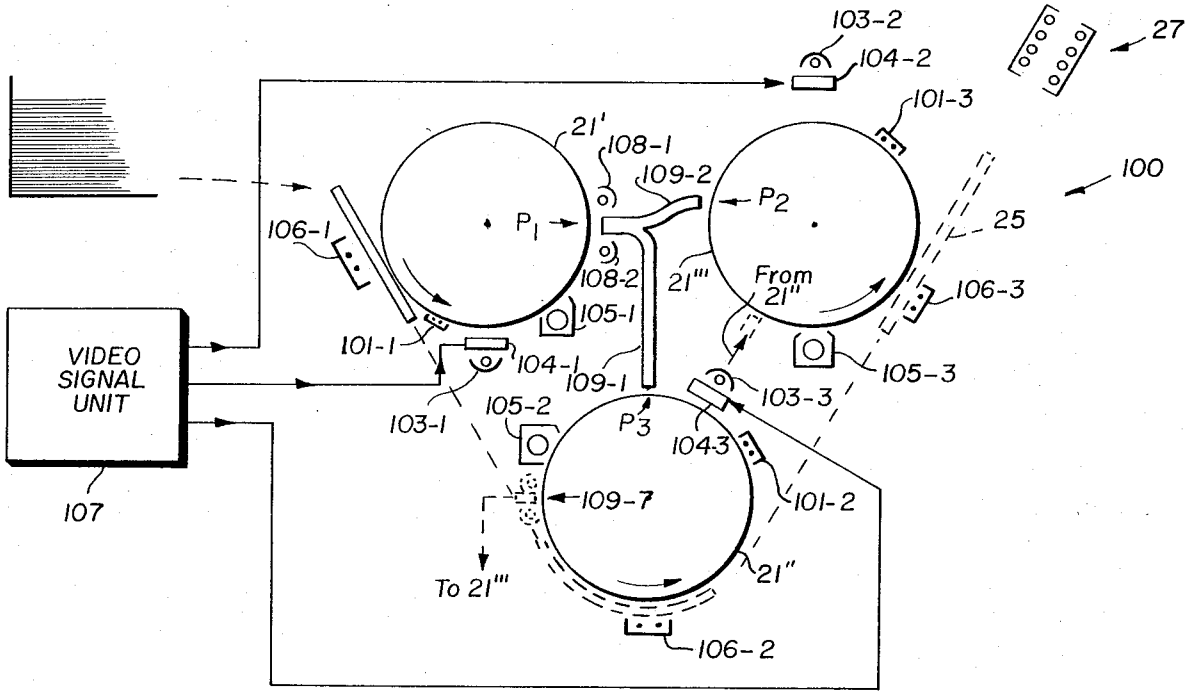
FIG. 10 is a schematic side view of another embodiment of the present invention.

Another example of the present invention is shown in FIG. 10, which is a schematic side view of another embodiment of electrophotographic apparatus 100 for producing multicolor copies of a multicolor original. In apparatus 100 the multicolor original is a record containing a plurality of video signals, each comprising information for a respective color-separation component of the composite multicolor image to be reproduced. The signals are provided by unit 107 respectively to control light valve arrays 104-1, 104-2 and 104-3 to effect different color-separation exposures on photoconductors 21', 21'' and 21''', in this embodiment on separately rotating drums. The light sources 103-1, 103-2 and 103-3 in this embodiment can be of the same or different wavelength but are matched to the sensitivity of their respective photoconductor (which also can be the same or different). The different color information for each different exposure is contained in the different video signals.

In operation sector 21' is uniformly charged by unit 101-1 and exposed via source 103-1 light valve array 104-1 in accord with one color information component of the multicolor image to be reproduced, e.g., the red color-separation information. The latent electrostatic image formed by this exposure is then developed by development device 105-1, as sector 21' moves therepast.

Concurrently, other electrostatic color-separation images are being formed by similar procedures on sectors 21'' and 21'''; however, different information signals, e.g., for the green and blue color content of the original are forwarded to light valve arrays 104-2 and 104-3. The movement of photoconductor sectors 21', 21'' and 21''' are synchronized so that the developed toner image on sector 21' reaches position $P_1$ at the time the electrostatic images on sectors 21'' and 21''' respectively reach positions $P_2$ and $P_3$. Sources 108-1 and 108-2 are activated to reflect light from the toner image on 21' and the reflected light is guided by fiber optic bundles 109-1 and 109-2, in register, respectively to discharge the electrostatic images on sectors 21'' and 21'''. The wavelength(s) of sources 108-1 and 108-2 are selected so as to be scatter-reflected. from the toner on their respective developed image (e.g., cyan toner) and to be able to discharge the photoconductors of sectors to which they are directed.

After such color correcting discharge the electrostatic images on sectors 21'' and 21''' are developed. A transfer sheet 25 is fed along a transfer path into transfer relation with each of the developed toner images, and corona units 106-1, 106-2 and 106-3 effect registered transfer of each toner image to the copy sheet. The composite toner image on the copy sheet is then fixed by fusing device 27, in this embodiment a radiant heat source. As indicated by dotted lines at 109-7, a second source can be provided to reflect light from a developed toner image on sector 21'' and optical structure provided to guide reflected light in register to an electrostatic color-separation image on sector 21'''.

Figure 11:
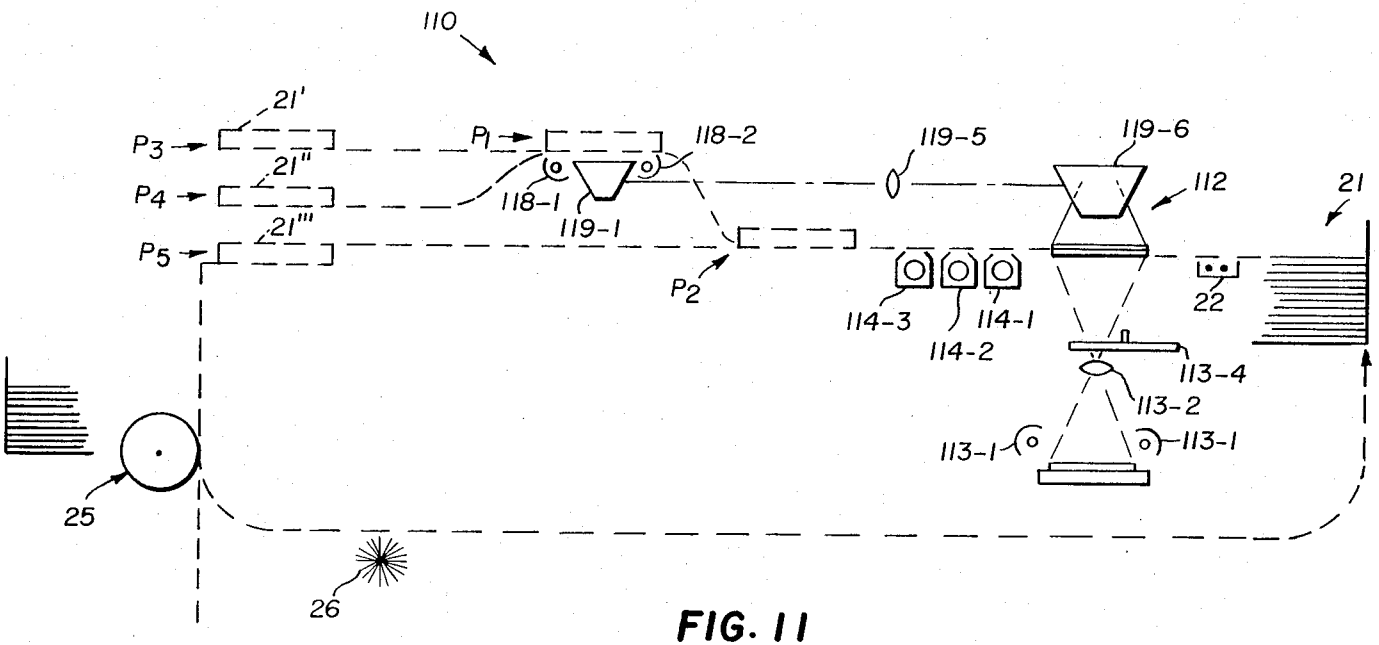
FIG. 11 is a schematic side view of another embodiment of the present invention.

Another example of the present invention is shown in FIG. 11 which is a schematic side view of another embodiment, apparatus 110, for producing multicolor copies from a multicolor original. In the apparatus 110 the color-correcting exposures are made at the main exposure station 112, i.e. the station where the imagewise color-separation exposure of the sector to the original is effected by sources 113-1 and lens 113-2. In this embodiment the photoconductor sectors 21 are film sheets having transparent supports and transparent conductive layers underlying the photoconductive insulator layer.

In operation of apparatus 110 a first photoconductor sector 21' is uniformly charged by primary corona unit 22 and exposed to a first color-separation light image through an element of filter array 113-4. The photoconductor sector 21' is then moved to position $P_1$ and during this movement the electrostatic color-separation image on sector 21' is developed by device 114-1. A second photoconductor sector 21'' is then uniformly charged and moved to station 112, for exposure to the original via a different filter of array 113-4. Before, during or after the main color-separation exposure by sources 113-1, the sources 118-1 and 118-2 are activated to reflect light from the toner image on photoconductor sector 21'. The toner-reflected light from sector 21' is guided by optical structure 119 (including mirror 119-1, lens 119-5, mirror 119-6 and other elements not shown) through the transparent support of conductive layer of sector 21'' and into proper register to color-correct-discharge the photoconductive insulator layer of sector 21''. The film sector 21'' is then developed by device 114-2 and moved to position $P_2$. A third photoconductor sector 21''' is then uniformly charged, moved to station 112, imagewise exposed through a different color-separation filter and color-correction exposed by 118-1, 118-2 and optical light guide structure 119. If desired, photoconductor sector 21' can then be moved to position $P_3$, sector 21'' moved to position $P_1$ and a second color-correction-exposure effected from the toner on sector 21'' to sector 21'''. This procedure can compensate the electrostatic image of sector 21''' for unwanted absorption (with respect to the sector 21''' light exposure color) of the toner on sector 21''. Sector 21'' is then moved to position $P_4$ and sector 21''' is developed by device 114-3 and moved to position $P_5$. Successive transfers of the toner images can then be effected in a desired sequence to a copy sheet at station 25. The copy sheet is then fixed as described previously and the sectors 21 are cleaned by device 26 and returned to their supply.

To provide an indication of the general magnitudes of voltage and exposure levels involved in practice of the present invention, the following illustrative example is provided. Separate frames of a specularly reflective organic photoconductor member (including a photoconductive insulator layer overlying a conductive layer on a support) were primary-charged to a voltage of about −450 and then respectively main-exposed to successive color-separation images of a multicolor photographic print. The $D_{max}$ and $D_{min}$ in levels of the electrostatic color-separation images were about −400 volts and −60 volts. The image exposure was made through a half-tone screen such as shown in FIG. 2A so that $D_{max}$ and $D_{min}$ levels represent average levels of those electrostatic image portions. The developed cyan toner image was then illuminated by a system similar to that shown and described with respect to in FIG. 2A with an illumination level such that the scatter-reflected light directed in register to the green color separation image caused color correction discharge of about −60 volts on portions of the electrostatic image corresponding to $D_{max}$ cyan toner areas of the developed sector. After completion of the electrophotographic process, such as described with respect to FIG. 2A, the resultant copy of the photograph original exhibited improved reproduction of green image portions without degradation of red image portions, as compared to the electrophotographic process reproduction but without the scatter-mask color correction.

The invention has been described in detail with particular reference to preferred embodiments thereof, but it will be understood that variations and modifications can be effected within the spirit and scope of the invention.

What is claimed is:

1. An electrophotographic color imaging apparatus comprising a plurality of photoconductor image sectors, means for forming a plurality of different electrostatic color-separation images respectively on different image sectors, means for developing such different electrostatic images respectively with different color toner and masking means for reflecting light from the toner image on one developed photoconductor image sector, in register, to the electrostatic color-separation image on an undeveloped photoconductor image sector, whereby portions of the undeveloped sector are discharged in proportion to the toner density on their corresponding portions of the developed sector.

2. The invention defined in claim 1 further including means for adjusting the tone scale of the light image reflected from said toner image to said electrostatic color-separation image.

3. The invention defined in claim 2 including control means for effecting a predetermined tone scale adjustment which compensates for an unwanted absorption characteristic of the toner on said developed sector with respect to the light color intended to be absorbed primarily be the different toner for said undeveloped sector.

4. The invention defined in claim 2 or 3 wherein said adjusting means is selectively variable.

5. In electrophotographic imaging apparatus of the type wherein a plurality of photoconductor image sectors are transported in timed relation along an operative apparatus path(s) past apparatus charging and exposure stations to form thereon different electrostatic color-separation images of a multicolor image and respectively transported into developing relation with apparatus development means to respectively receive different color toners, improved masking means comprising:

(a) means, located along said operative path(s), for directing uniform light which: (1) is diffusely reflectable by such toner but not by said photoconductor sectors and (2) is actinic to said photoconductor sectors, onto a developed toner image on one of said sectors and (b) means for directing the light pattern diffusely reflected from the developed toner image, in register, onto the electrostatic color-separation image on another, undeveloped photoconductor image sector.

6. Apparatus for producing multicolor copies from a multicolor original comprising a plurality of non-diffusely-reflective photoconductor sectors, means for forming different electrostatic color-separation images on respective photoconductor sectors, means for developing such different electrostatic images respectively with different color toner, and masking means including masking illumination means for directing uniform light, which is effectively scatter-reflected by such toner and to which said photoconductor sectors are photosensitive, onto a developed color-separation image and means for guiding light which is scatter-reflected by the toner of the developed color-separation image in imagewise register onto another electrostatic color-separation image prior to its development with a second color toner.

7. In an electrostatographic imaging apparatus of the type wherein a plurality of image sectors, each including a photoconductive portion, are respectively: (1) processed to form different latent electrostatic image constituents of a color image and (2) developed with different complementary-color developer, the improvement comprising masking means for modifying the latent electrostatic image on at least one image sector prior to its development by a registered light reflection exposure to another, previously developed, of such image sectors.

8. In electrophotographic apparatus of the type having a plurality of photoconductor image sectors, means for primary-charging such sectors, means for exposing such charged sectors, respectively through different color filters to a multicolor original to be reproduced to produce a plurality of different electrostatic color-separation images and means for developing such different electrostatic images respectively with different color toner, the improvement comprising masking means for reflecting light from the toner image on one developed photoconductor image sector, in register, to the electrostatic color-separation image on another photoconductor image sector.

9. The invention defined in claim 8 further including means for adjusting the tone scale of light-reflection exposure of said electrostatic color-separation image from said toner image.

10. The invention defined in claim 9 including control means for effecting predetermined tone-scale adjustments based on the unwanted light absorption characteristic of said toner and/or filter/input-colorant exposure error.

11. The invention defined in claim 8 or 9 wherein said adjusting means includes means for selectively adjusting the tone scale of such masking exposure.

12. The invention defined in claim 2 or 9 including control means for effecting a plurality of different predetermined tone-scale adjustments by said adjusting means respectively for masking exposures between different toner/electrostatic image pairs.

13. In electrophotographic imaging apparatus of the type wherein a plurality of photoconductor image sectors are transported sequentially along an operative electrophotographic process path(s) past apparatus charging and exposure stations to form different electrostatic color-separation images of a multicolor image and respectively into developing relation with different development stations containing different color toner, the improvement comprising masking means, located along the basic electrophotographic process path(s), for exposing the undeveloped electrostatic color-separation image on one photoconductor image sector to the registered, scatter-reflection light pattern of the toner on another developed photoconductor image sector, whereby color correction of a photoconductor image sector(s) can be effected along their basic electrophotographic process path(s).

14. The invention defined in claim 13 wherein said masking means comprises means for mask illuminating a developed image sector at a first position located along that sector's path of travel from its development station to a transfer station and means for directing masking illumination which is scatter-reflected from that sector, in register, to a second position along the operative path of travel of a second image sector from its exposure station to its development station.

15. The invention defined in claim 14 wherein said image sectors are formed on a continuous belt which traverses an endless operative path past said electrophotographic stations.

16. The invention defined in claim 14 wherein said image sectors are discrete and each have an at least partially different path of travel in said apparatus.

17. In apparatus for electrophotographically producing multicolor copies from a multicolor original by charging, exposing and developing photoconductor sectors to form different color-separation toner images, the improvement comprising masking means including illumination means for scatter-reflecting light from the toner of a developed color-separation image and optical means for guiding light which is scatter-reflected by the toner of the developed color-separation image in register onto another electrostatic color-separation image prior to its development, with a second color toner.

18. Apparatus for electrophotographically producing multicolor reproductions of multicolor input information comprising:

means for uniformly charging a plurality of photoconductor image sectors;

means for sequentially exposing such uniformly charged sectors to color-separation images respectively of the multicolor input information, thereby forming different electrostatic charge patterns on such sectors which respectively correspond to such color-separation images, means for developing the charge pattern on the first sector with complementary colored toner to form a first developed image on such first sector;

masking means for color correcting the charge patterns on at least one other of said sectors by exposing it to a reflected light image of said first developed image;

means for developing the other image sectors respectively with complementary colored toners; and means for sequentially transferring said developed toner images in accurate superimposed register to a receiver.

19. The invention defined in claim 1, 5, 6, 7, 8, 13, 17 or 18 wherein said masking means is adapted for reflecting light from the toner image on one sector, in register, to a plurality of other electrostatic-images-bearing sectors.

20. The invention defined in claim 1, 5, 6, 7, 8, 13, 17 or 18 wherein said masking means is adapted for reflecting light from a plurality of different developed sectors to another electrostatic- image-bearing sector.

21. The invention defined in claim 19 further including means for adjusting the tone scale of inter-sector light exposure.

22. The Invention defined in claim 20 further including means for adjusting the tone scale of inter-sector light exposure.

23. The invention defined in claim 21 wherein said adjusting means includes means for effecting different tone-scale exposures between different toner image-electrostatic image pairs.

24. The invention defined in claim 22 wherein said adjusting means includes means for effecting different tone-scale exposures between different toner image-electrostatic image pairs.

25. The invention defined in claim 1, 5, 6, 7, 8, 13, 17 or 18 wherein said photoconductor sectors are specularly reflective and wherein said masking means is constructed and located:

(a) to direct light obliquely onto a developed sector so that light is scatter reflected from toner on such photoconductor sector and specularly reflected by non-toner-bearing photoconductor sector portions; and (b) to transmit only the scatter reflected light to the electrostatic image-bearing sector.

26. The invention defined in claim 1, 5, 6, 7, 8, 13, 17 or 18 further including adjustment means for varying the intensity of masking light directed onto the toner images.

27. The invention defined in claim 1, 5, 6, 7, 8, 13, 17 or 18 further including adjustment means for varying the spectral content of masking light directed onto the toner images.

28. The invention defined in claim 1, 5, 6, 7, 8, 13, 17 or 18 further including adjustment means for varying the geometry of the optical path of the masking light.

29. The invention defined in claim 1, 5, 6, 7, 8, 13, 17 or 18 further including adjustment means for varying the time of exposure of such electrostatic image to such toner-reflected light.

30. The invention defined in claim 1, 5, 6, 7, 8, 13, 17 or 18 wherein said photoconductor sectors are highly transmissive to said masking means light.

31. The invention defined in claim 1, 5, 6, 7, 8, 13, 17 or 18 wherein said photoconductor sectors are highly absorptive to said masking means light.

32. The invention defined in claim 1, 5, 6, 7, 8, 13, 17 or 18 including means for controlling transfer of developed toner images from said sectors to a transfer member in a sequence different than the sequence of sector development.

33. A method of correcting for unwanted light absorptions in electrographic toners used in developing related electrostatic color-separation images on photoconductive media, said method comprising:

illuminating a developed color-separation image, having unwanted light absorptions, to produce a light pattern representative of the unwanted light absorptions and modulating, in register, at least one of the related electrostatic color-separation images with such light pattern prior to development.

34. A method of forming a multicolor reproduction of a multicolor image record comprising the steps of:

(a) forming at least first and second electrostatic color-separation images on separate photoconductor frames;

(b) developing said first color-separation image with a first color toner;

(c) illuminating said developed first image to provide a light pattern indicative of the toner pattern thereon;

(d) color-correcting the charge of said second electrostatic color-separation image with said light pattern from said developed first image;

(e) developing said second image with a second color toner; and (f) disposing said toner images in register.

35. A method for electrophotographically producing multicolor reproductions of multicolor input information comprising the steps of:

uniformly charging a plurality of photoconductor image sectors;

sequentially exposing such uniformly charged sectors to color-separation images respectively of the multicolor input information, thereby forming different electrostatic charge patterns on such sectors which respectively correspond to such color-separation images;

developing the charge pattern in the first sector with complementary colored toner to form a first developed image on such first sector;

color correcting the charge patterns on at least one other of said sectors by exposing it to a reflected light image of the toner on said first developed image;

developing the other image sectors respectively with complementary colored toners; and sequentially transferring said developed toner images in accurate superimposed register to a receiver.

36. In an electrographic imaging method wherein a plurality of photoconductor image sectors are respectively processed to form different color-separation portions of a color image and respectively developed with different color toner, the improvement comprising modifying the electrostatic image on at least one photoconductor image sector prior to its development by a registered light reflection exposure to another, previously developed, of such photoconductor image sectors.

37. In an electrophotographic imaging method of the type wherein a plurality of photoconductor image sectors are respectively primary-charged, exposed to different color-separation light images of a predetermined color original, and developed with different color toner, the improvement comprising the step of reflecting light from the toner on a developed one of said sectors, in registry to the electrostatic color-separation image or another, undeveloped one of said sectors.

38. The method defined in claim 37 further comprising the step of adjusting the scale of the light image reflected from said toner image to said electrostatic color-separation image.

39. The method defined in claim 38 wherein said adjusting step comprises effecting a predetermined tone scale based on the unwanted absorption characteristic of said toner vis-a-vis the light color intended to be absorbed primarily by the different toner for said undeveloped image.

40. The method defined in claim 38 or 39 wherein said adjusting step comprises selectively adjusting the tone scale based on exposure inaccuracy caused by a mismatch of an exposing filter vis-a-vis an input original colorant.

41. In a method for producing multicolor copies of a multicolor original which includes producing a developed color-separation image of a first color toner on a first photoconductor sector, the improvement comprising adjusting another electrostatic color-separation image on another photoconductor sector, prior to its development with a second color toner, by exposure to light that is scatter-reflected from the first color toner of the developed color-separation image and guided in register to the electrostatic color-separation image.

42. The invention defined in claim 33, 34, 35, 36, 37 or 41 further comprising the step of adjusting the intra-image intensities of the intersector light exposure.

43. The invention defined in claim 42 wherein such adjustment is effected by varying the optical path of such inter-sector light exposure.

44. The invention defined in claim 42 wherein such adjustment is effected by varying the time of such inter-sector light exposure.

45. The invention defined in claim 42 wherein such adjustment is effected by varying the intensity of light directed onto such toner image.

46. The invention defined in claim 42 where such adjustment is effected by varying the spectral content of light directed onto such toner image.

47. The invention defined in claim 33, 34, 35, 36, 37 or 41 wherein masking light is exposed from the toner on one sector to a plurality of other electrostatic image sectors.

48. The invention defined in claim 33, 34, 35, 36, 37 or 41 wherein masking light is scatter-reflected to at least one electrostatic image-bearing sector from a plurality of toner-bearing image sectors.

49. The invention defined in claim 33, 34, 35, 36, 37, or 41 further including the steps of transferring toner images from said sectors to a transfer member in a sequence different than the sequence of sector development.

50. A color copier apparatus for producing a color copy of a multicolor original, said apparatus comprising a recording element having a plurality of spaced image sectors, means for imagewise exposing said image sectors to different color-separated images of the original to form a direct color-separated latent image on each sector, means for serially developing such different latent images respectively with different color toner, and means for selectively illuminating at least one of latent images with light to render certain portions less attractive to toner, characterized in that said illuminating means comprises means for illuminating a developed image and means for imagewise projecting the illuminated image into registry with said one latent image on the recording element.

* * * * *